United States Patent [19]

Azzato

[11] 4,152,013

[45] May 1, 1979

[54] RAINSHED BINDER

[75] Inventor: Robert N. Azzato, Phoenix, Ariz.

[73] Assignee: General Binding Corporation, Northbrook, Ill.

[21] Appl. No.: 874,514

[22] Filed: Feb. 2, 1978

[51] Int. Cl.[2] ..... B42D 3/02

[52] U.S. Cl. ..... 281/15 A; 281/20; 402/76

[58] Field of Search ..... 281/15 A, 20; 402/76, 402/77

[56] References Cited

U.S. PATENT DOCUMENTS

| | | | |
|---|---|---|---|
| 792,664 | 6/1905 | Miller | 402/76 X |
| 1,238,899 | 9/1917 | Enell | 281/15 A |
| 1,669,940 | 5/1928 | Jones | 402/76 X |
| 3,252,461 | 5/1966 | Schade | 402/76 X |

FOREIGN PATENT DOCUMENTS

| | | | |
|---|---|---|---|
| 552787 | 4/1943 | United Kingdom | 281/20 |
| 1104022 | 2/1968 | United Kingdom | 402/76 |

*Primary Examiner*—Robert L. Spicer, Jr.

*Attorney, Agent, or Firm*—Hill, Van Santen, Steadman, Chiara & Simpson

[57] ABSTRACT

An improved rainshed binder is disclosed for protecting a book from environmental weather conditions. The binder has first and second covers each of which have rainshed protecting walls connected to inside surface side edges of the covers. An integral binder backbone connects the first and second covers. The backbone has a pair of linear polyethylene hinges positioned inwardly of outer rigid, non-flexible corners of the backbone. The backbone connects in integral manner with the first and second covers at the rigid corners. An attachment plate secures the book to be protected to the backbone between the flexible hinges. The rigid corners of the backbone are free to flex relative to the book attachment plate by the provision of the hinges. The binder is designed to hang downwardly in closed fashion when the book is not in use. By providing the hinges inwardly of the rigid corners of the backbone, a center of gravity of each of the covers and connected rainshed protecting walls is laterally outwardly of the hinges so as to create an inwardly directed force for each of the covers so as to cause the rainshed protecting walls to overlap one another in a closed fashion.

13 Claims, 6 Drawing Figures

Fig. 1A
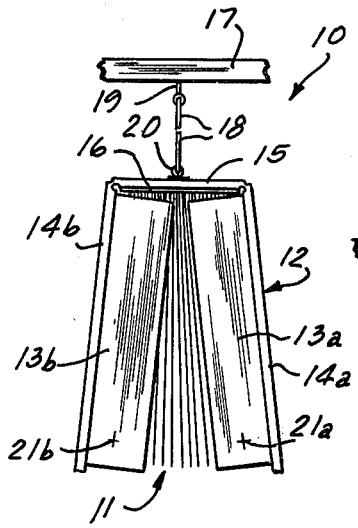
Fig. 1B
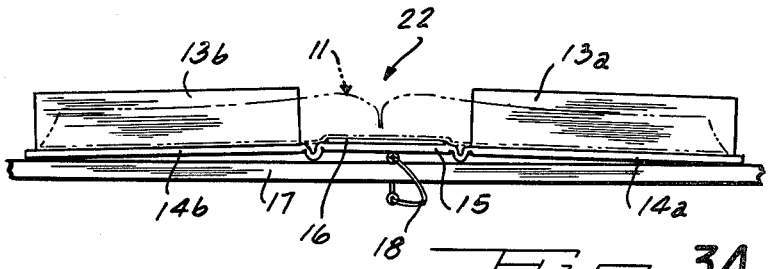
Fig. 3A
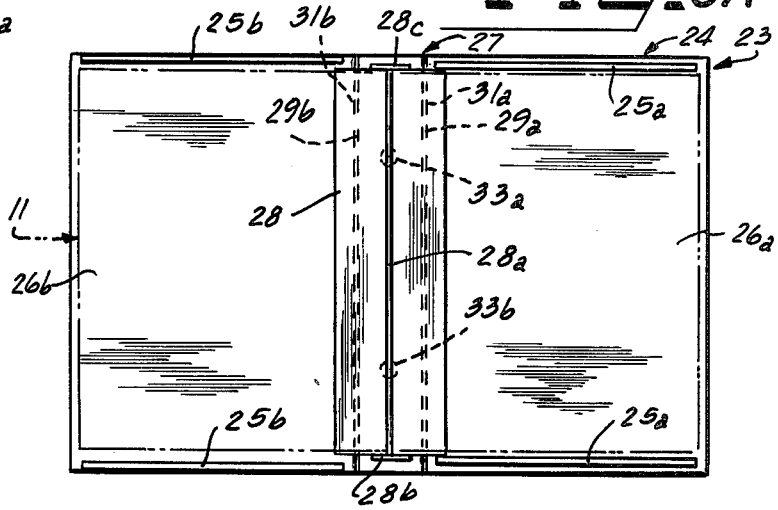
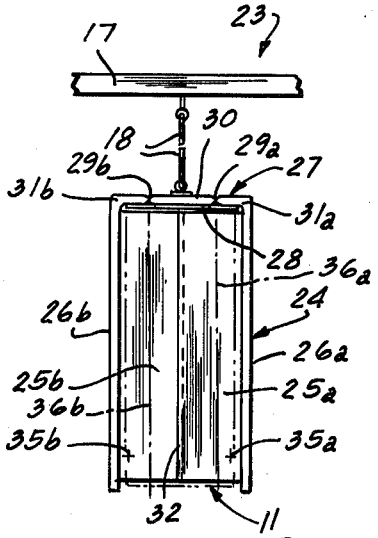
Fig. 2
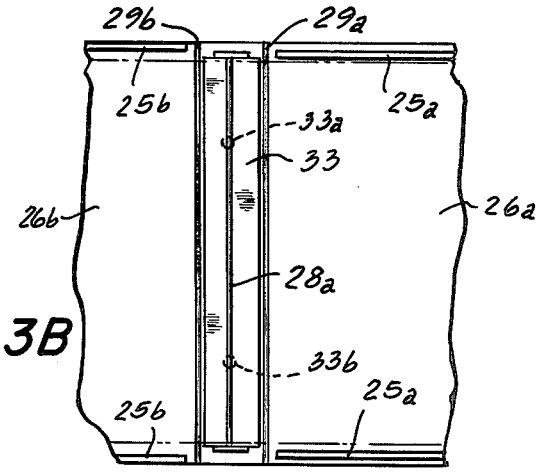
Fig. 3B
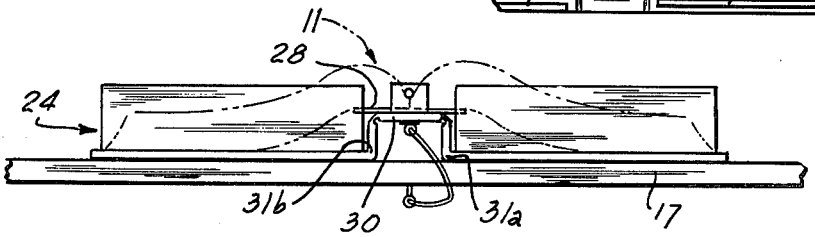
Fig. 4

RAINSHED BINDER

BACKGROUND OF THE INVENTION

This invention relates to rainshed binders for protecting books, particularly telephone books from environmental conditions such as weather.

Recently, telephone boothes have increased in size to a point where the accompanying telephone book often must be mounted outside a telephone booth for lack of space inside. Accordingly, it has become desirable to provide a binder for protecting such telephone books, particularly when such books are hung vertically from a backbone of the binder wherein the backbone remains in a substantially horizontal position.

As hinges for binders used to protect books, it has been known to use molded polypropylene as a hinge between a backbone of the binder and its covers. Many materials will serve as a hinge if their cross-section is thin enough. However, thin sections in covers usually lack adequate flex life and resistance to vandalizing by tearing. Molded polypropylene is well known for its use as a "miracle hinge." This term usually refers to its extraordinary long hinge flex life. Unfortunately, in thin sections this material is too stiff to be used as a hinge in telephone books. Modified linear polyethylene, on the other hand, is a compromise material which has had good success in typical telephone book binder environments. Modified linear polyethylene is linear polyethylene which is modified by additions to promote flexibility as is well known in the art.

Disregarding toughness and flex life, the use of polypropylene, modified linear polyethylene, or other thermoplastic materials having molded or formed hinges is complicated by the fact that these materials when deformed have poor memories. This causes a book cover, when opened or closed, tend to stay in its last position unless restored by force. Accordingly, a telephone book might be hung downwardly so that covers tend to stay shut. When the book is brought up to a counter and opened by hand, the covers now, however, stay open. When the book is restored to its original position, the covers tend to stay open and only restore to their hangdown position slowly under the force of gravity. Some materials will not restore at all. In these circumstances, the designer is tempted to modify the chemical characteristics of the binder material to obtain a less stiff hinge but in so doing, he may decrease the hinge flex life so much that the usefulness of the book is jeopardized.

SUMMARY OF THE INVENTION

It is an object of this invention to provide an improved protective book binder wherein covers of the binder having rainshed protecting walls attached thereto remain in a closed position when the binder is hung downwardly with the backbone essentially horizontal.

It is another object of this invention to utilize plastic hinges integral with a backbone wherein such hinges are inwardly spaced from outer rigid corners of the backbone so that the center of gravity of the covers lie laterally outwardly of the hinges so as to impart a closing force on the hinges.

According to the invention, a rainshed binder for protecting a book from environmental conditions such as weather is provided wherein the binder has first and second covers, each of which have rainshed protecting walls positioned along inside surface side edges thereof.

The protecting walls are substantially orthogonal with respect to the inside surface of the covers. A binder backbone extending between and connecting to the first and second covers has a central portion and first and second rigid corner portions. The corner portions are preferably at right angles and constitute a non-hingeable integral connection between the backbone and the respective first and second covers. First and second plastic hinges are provided for attaching the backbone central portion to the first and second backbone corner portions. The first and second hinges are positioned such that when the book is hung dowwardly from its backbone and the backbone is substantially horizontal, the first and second hinges are laterally inwardly of the respective center of gravity points of the combined mass of the first and second covers with their respective rainshed protective walls.

BRIEF DESCRIPTION OF THE DRAWINGS

FIG. 1A is a side view of a rainshed binder in a hanging position with the covers and attached rainsheds only partially closed;

FIG. 1B is a side view of the rainshed binder of FIG. 1A in an open position and lying on a shelf;

FIG. 2 is a side view of an improved rainshed binder hanging downwardly in a closed and protected position with a backbone of the binder substantially horizontal;

FIG. 3A is a top view of the improved rainshed binder of FIG. 2 with the covers open;

FIG. 3B is a top fragmentary view of an alternate embodiment of the rainshed binder of FIG. 3A; and FIG. 4 is an end view of the improved rainshed binder of FIG. 2 in an open position and lying on a shelf.

DESCRIPTION OF THE PREFERRED EMBODIMENTS

A rainshed binder with a protected book is generally shown at 10 in FIG. 1A. A telephone book 11 or other book to be protected is protected from environmental conditions such as weather by a rainshed binder 12. The binder may be fabricated from one piece self-hinging modifed linear polyethylene. A rainshed **13*a* or 13*b* protrudes in an orthogonal manner from an inside planar surface of binder covers 14*a* and 14*b*, respectively. Two rainshed walls are formed along peripheral side edges of the inside surface of the book covers. They may be integrally molded with the covers or of an L shape with a bottom of the L functioning as a supporting base. A book attachment plate 16 is provided which is secured to the binder backbone 15. A supporting surface or shelf 17 is typically provided upon which the protected book may be laid in an open position for use. When not in use, the protected book is hung downwardly from a securing member 19 attached to the shelf 17. An attachment cable 18 connected to the securing member attaches to an attachment member 20 on the binder backbone 15. Preferably, the attachment member 20 is centered such that in a free hanging position, the backbone 15** is substantially horizontal.

With the rainshed binder 12 of FIG. 1A, the center of gravity points **21*a* and 21*b* lie in a vertical line below the flexible hinge connections between the backbone 15 and the covers 14*a* and 14*b*. Accordingly, the book 11 is not fully protected since the covers 14*a* and 14*b* with attached rainsheds 13*a* and 13*b*** does not fully close.

A rainshed binder of FIG. 1A is shown in an open position at 22 in FIG. 1B with the binder resting on a shelf 17.

In an improved rainshed binder with a protected book as shown generally at 23 in FIG. 2, the book 11 is completely protected since no gaps or spacings exist due to incomplete closure of the covers with their associated rainshed walls. The improved rainshed binder 24 has rainshed walls 25*a* and 25*b* similar to that shown in FIG. 1A. As shown in FIG. 3A, the rainshed walls 25*a* and 25*b* extend around outer edges of the covers 26*a* and 26*b* of the binder 24 but not adjacent to the binder backbone 27.

The binder backbone 27 is comprised of a center portion 30 and rigid right angle corner portions 31*a* and 31*b* on opposite sides of the center portion 30. Flexible hinges 29*a* and 29*b* respectively connect the corner portions 31*a* and 31*b* to opposite sides of the center portion 30. The hinges 29*a* and 29*b* are preferably integral with the binder backbone 27 and are comprised of modified linear polyethylene, that is linear polyethylene which is modified by additions which promote flexibility as is well known in the art. Alternatively, polypropylene or other thermoplastic materials may be used to form the hinges in integral manner. However, modified linear polyethylene is preferred.

The peripheral dimensions of the rainshed 25*a* are slightly larger than the peripheral dimensions of the two sided rainshed 25*b* so that when the book binder is hanging in a vertical position as shown in FIG. 2 with the backbone 27 substantially horizontal, the rainshed 25*a* overlaps the rainshed 25*b*.

In order to ensure a complete closure of the rainsheds 25*a* and 25*b* and the associated covers 26*a* and 26*b*, the hinges 29*a* and 29*b* are laterally positioned in the backbone 27 such that center of gravity points 35*a* and 35*b* are outwardly of a vertical line 36*a* or 36*b* passing through the hinges 29*a* and 29*b*. Accordingly, gravitational forces cause the covers 26*a* and 26*b* to be biased inwardly towards one another so as to effect automatic closure.

An attachment plate 28 may be provided for the improved rainshed binder 23 of the invention as shown in FIG. 3A. Here the book attachment plate 28 extends between corner portions 31*a* and 31*b*. The attachment plate 28 is secured only to the center portion 30 of the backbone 27 at 33*a* and 33*b*, for instance. An attachment wire 28*a* supported between support members 28*b* and 28*c* on the attachment plate 28 effects a securement of the book to the attachment plate 28 as is known in the art and exemplified by U.S. Pat. Nos. 3,705,706 and 3,894,754.

With the attachment plate shown in FIG. 3A, when the book is in the closed position shown in FIG. 2, the plate 28 prevents further inward movement of the covers 26*a* and 26*b* towards one another. On the other hand, as shown in FIG. 3B, in an alternate embodiment 33 of the back plate, the back plate has a width which is equal to or less than the distance between the hinges 29*a* and 29*b*. This embodiment is more suitable for smaller books having narrower backbones. In this embodiment, the attachment plate 28 does not prevent the covers 26*a* and 26*b* from approaching each other due to the influence of gravitational forces.

Finally, FIG. 4 illustrates the improved rainshed binder 24 in an open position on a table 17. Here it can be clearly seen that outer edges of the attachment plate 28 extend beyond this central portion 30 of the binder backbone 27.

Although various minor modifications may be suggested by those skilled in the art, it should be understood that I wish to embody within the scope of the patent warranted hereon, all such embodiments as reasonably and properly come within the scope of my contribution to the art.

I claim as my invention:

1. A rainshed binder for protecting a book from environmental conditions, comprising:

(a) first and second covers;

(b) a rainshed protecting wall connected to the covers;

(c) a binder backbone connecting the first and second covers, said backbone having a pair of hinge means inwardly of outer rigid non-flexible corners of the backbone, said rigid corners connecting the backbone to the covers;

(d) a book attachment means secured to the backbone between the hinge means, the rigid corners of the backbone being free to flex relative to the book attachment means; and (e) hanging means attached to the backbone for suspending the binder with a protected book in a downward closed position;

whereby the inwardly positioned hinge means cause closing of the binder covers and attached rainshed walls by gravitational forces acting on the covers and rainshed walls.

2. A rainshed binder for protecting a book from environmental conditions, comprising:

(a) first and second covers;

(b) a rainshed protecting wall positioned along peripheral edges of each of the first and second covers, said protecting wall being substantially orthogonal with respect to a planar surface of the covers;

(c) a binder backbone extending between the first and second covers, said backbone having a central portion and first and second corner portions, said corner portions each comprising a rigid right angle non-hingeable connection between the backbone and the respective first and second covers; and (d) first and second hinge means for respectively attaching the backbone central portion to the first and second backbone corner portions.

3. The binder of claim 2 in which the hinge means comprises a thinned section of flexible plastic material.

4. The binder of claim 3 in which the hinge means is integral with the backbone and comprises the same material as the backbone.

5. The binder of claim 3 in which the hinge means comprises modified linear polyethylene.

6. The binder of claim 2 in which the hinge means comprises a section of thermoplastic having depressions on opposite surfaces.

7. The binder of claim 2 in which the binder backbone, first and second covers, and hinge means are integral and of one piece construction.

8. The binder of claim 2 in which the first and second hinge means are positioned such that when the book is in a hanging position with the backbone horizontal, the first and second hinge means are laterally inwardly of the respective center of gravity points of the combined mass of the first and second covers, respective rainshed protective walls, and backbone corner portions.

9. The binder of claim 8 in which protective walls on the first cover overlap the protective walls of the second cover when the binder is in said hanging position.

10. The binder of claim 2 in which an attachment means is provided for mounting a book to be protected to the central portion of the backbone, said backbone first and second corner portions being free to swing away from edge portions of the attachment means.

11. The binder of claim 10 in which the attachment means comprises a plate connected to the backbone central portion, said plate having a wire retaining means for supporting interaction with the book to be protected.

12. The binder of claim 2 in which an attachment means is provided for mounting a book to be protected to the central portion of the backbone, said attachment means having a width less than a distance between center lines of the first and second hinge means.

13. A rainshed binder for protecting a book from environmental conditions, comprising:

(a) first and second covers;

(b) first and second rainshed protecting walls at an inside surface of each cover and respectively positioned along first and second edges of the covers, said protecting walls being substantially orthogonal with respect to a planar surface of the covers;

(c) a binder backbone extending between the first and second covers, said backbone having a central portion and first and second corner portions, said corner portions each comprising a rigid right angle non-hingeable connection between the backbone and the first and second covers;

(d) first and second hinge means for respectively attaching the backbone central portion to the first and second corner portions, said hinge means integral with and of the same material as the backbone and comprising a flexible section of thinned polyethylene; and (e) book attachment means mounted to the backbone central portion, said backbone corner portions being free to swing away from the book attachment means.

* * * * *